US006494599B1

(12) United States Patent
Leen

(10) Patent No.: US 6,494,599 B1
(45) Date of Patent: Dec. 17, 2002

(54) ADAPTABLE LANDSCAPE LIGHT

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 0 days.

(21) Appl. No.: 09/881,158

(22) Filed: Jun. 14, 2001

(51) Int. Cl.[7] ..... F21V 15/00

(52) U.S. Cl. ..... 362/362; 362/368; 362/431; 362/153; 362/290

(58) Field of Search ..... 362/368, 362, 362/431, 153, 290

(56) References Cited

U.S. PATENT DOCUMENTS

| | | | | |
|---|---|---|---|---|
| 2,252,395 A | * | 8/1941 | Cohen | |
| 3,015,720 A | * | 1/1962 | Silverman | |
| 3,194,952 A | * | 7/1965 | Wells | 362/86 |
| 4,499,527 A | * | 2/1985 | Tauber et al. | 362/267 |
| 5,954,426 A | * | 9/1999 | Whittington | 362/414 |
| 6,357,892 B1 | * | 3/2002 | Beadle | 362/267 |

* cited by examiner

*Primary Examiner*—Thomas M. Sember
*Assistant Examiner*—Jacob Y. Choi

(74) *Attorney, Agent, or Firm*—Dean A. Craine

(57) ABSTRACT

An adaptable landscape light designed to be used with ½ inch or 3-inch diameter poles. The light includes a light housing with a cylindrical-shaped lower base. Formed on the lower base is a downward extending cavity. Three downward extending tabs are radially and equally spaced apart around the lower base. Each tab includes a threaded bore through which a threaded connector may be selectively attached. Included with the light is a conical-shaped adaptor with a cylindrical-shaped upper section designed to fit into the downward extending cavity formed inside the lower base. Formed on the adaptor is a narrow, centrally aligned neck member with a longitudinally aligned threaded bore formed therein. Formed on the sidewalls of the upper cylindrical section are threaded bores which are aligned with the threaded bores formed on the tabs or sidewalls of the lower base. During use, the upper cylindrical section is inserted into the lower cavity and attached thereto via the threaded connectors extended through the bores formed on the tabs and upper cylindrical section. A narrow, complementary-shaped threaded conduit may be connected to the neck member. If a wide conduit is desired, the adaptor is removed so that the wide conduit may be directly attached to the lower base.

4 Claims, 2 Drawing Sheets

ADAPTABLE LANDSCAPE LIGHT

BACKGROUND OF THE INVENTION

1. Field of the Invention

This invention pertains to landscape lights, and more particularly, to landscape lights attached to vertically aligned poles through which wiring extends to provide electric current to the landscape light.

2. Description of the Related Art

High and low voltage landscape lights are often mounted on rigid poles inserted at one end into the ground or into concrete. Wires connect lamps located inside the light to a distant electricity source.

Today, there are two diameter sizes of poles used to mount landscape lights—½-inch and 3-inch. Heretofore, most landscape light manufacturers make their lights to fit one size diameter pole. Thus, to appeal to customers needing one or the other size diameter pole, landscape manufacturers must manufacture two types of lights and make customers choose one size diameter pole. Needless to say, this increases the cost of manufacturing.

What is needed is a landscape light that can be used with a either ½ inch or 3-inch diameter poles.

SUMMARY OF THE INVENTION

It is an object of the present invention to provide an adaptable landscape light that can be used with a ½ or 3-inch diameter pole.

The landscape light includes a standard landscape light housing having a lower cylindrical-shaped lower base, a vertically aligned lens and upper cap structure disposed over the lens. The lower base includes a downward extending cavity with thin sidewalls. Extending downward from the sidewalls are equally spaced apart tabs. Each tab includes a perpendicularly aligned threaded bore through which a threaded connector may be selectively attached.

Included with the light is a conical-shaped adaptor with a cylindrical-shaped upper section designed to snugly fit into the cavity located on the lower base. Integrally formed on the upper section is a downward extending, centrally aligned, narrow neck member with a longitudinally aligned threaded bore formed therein. During use, the upper section on the adaptor is inserted into the cavity on the lower base and attached thereto via the threaded connectors extended through the tabs. A ½ inch complementary-shaped threaded conduit may be connected to the threaded bore in the neck member. If a 3 inch diameter pole is desired, the adaptor is removed so that the upper end of the 3 inch diameter pole may insert directly into the cavity. Threaded connectors are then used to securely connect the pole directly to the lower base.

There has been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DESCRIPTION OF THE PREFERRED EMBODIMENT(S)

Figure 2:
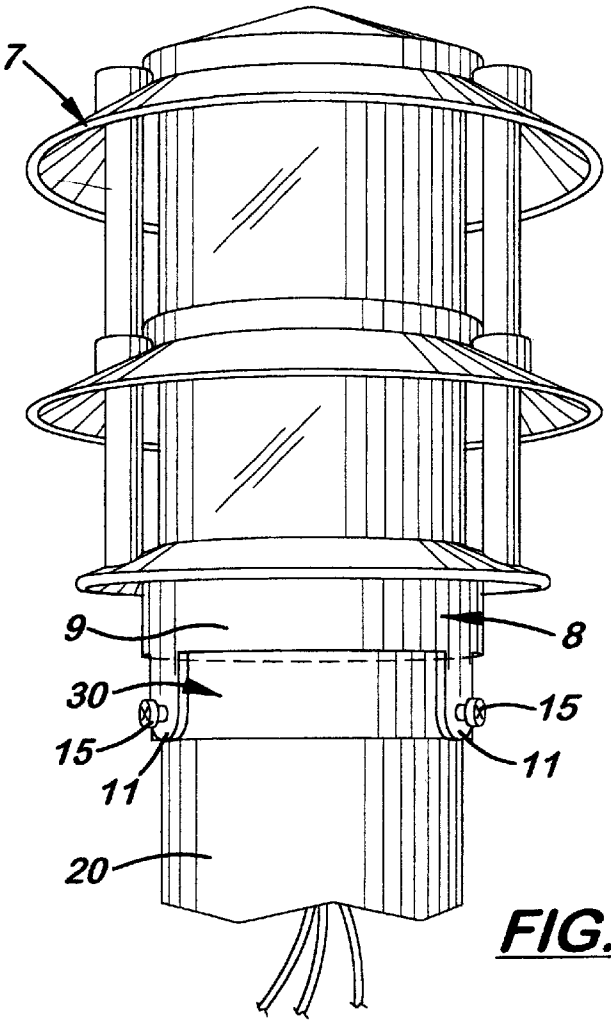
FIG. 2 is a side elevation view of the invention inserted into a pipe.

Referring to the accompanying FIGS. 1–7, there is shown and described an adaptable landscape light 6 designed to be used with narrow or wide diameter conduits 15, 20, respectively. The light 6 includes a light housing 7 and a wide cylindrical-shaped lower base 8 with a downward extending cylindrical-shaped cavity 9 formed therein. Extending downward from the sidewalls 9 of the lower base 8 are three vertically oriented tabs 11. The tabs 11 are radially and equally spaced apart around the lower base 8. Each tab 11 includes a perpendicular-aligned threaded bore 12 through which a threaded connector 15 may be selectively attached.

Included with the light 6 is an adaptor 30 with cylindrical-shape upper section 32 designed to fit snugly into the downward extending cavity 10 located inside the lower base 8. Located inside the upper section 32 is an upward extending cavity 33. Formed on the sidewall of the upper section 32 are three radially aligned threaded bores 35 which may be aligned and registered with the threaded bores 11 formed on the tabs 10. Integrally formed on the upper section 32 is a downward extending, centrally aligned narrow neck member 40 with a longitudinally aligned threaded bore 42 formed therein. During use, the upper section 32 is selectively inserted into the cavity 10 in the lower base 8 so that the threaded bores 35 on the adaptor 30 are aligned and registered with the threaded bores 12 on the lower base 8. Threaded connectors 15 are then extended through the bores 11 and 35 to connect the adaptor 30 to the lower base 8.

Figure 1:
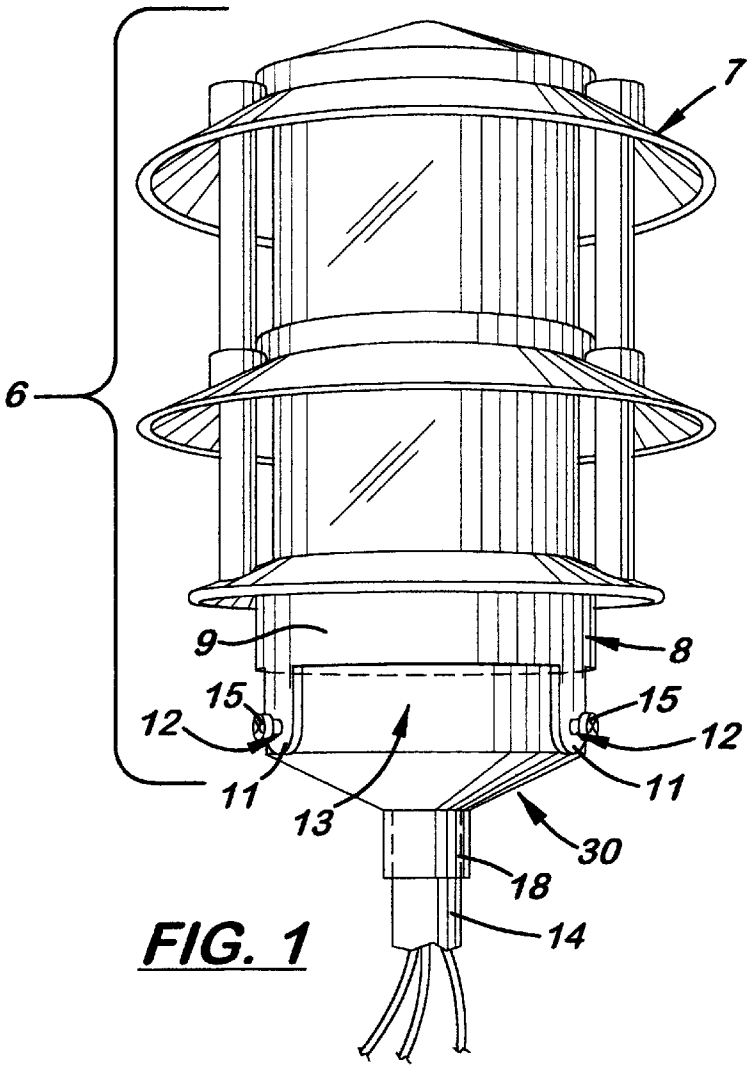
FIG. 1 is a side elevation view of the invention inserted into the wide cylindrical base of the upper portion of a landscape light unit.
Figure 3:
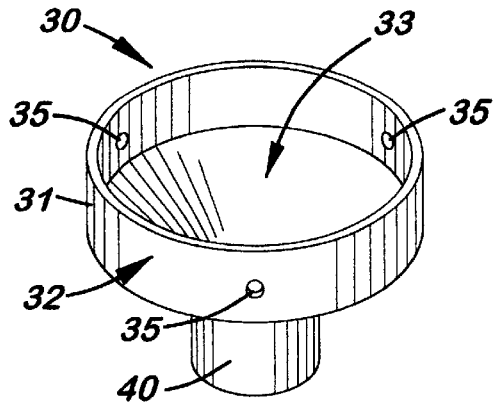
FIG. 3 is perspective view of the landscape light adaptor disclosed herein.
Figure 4:
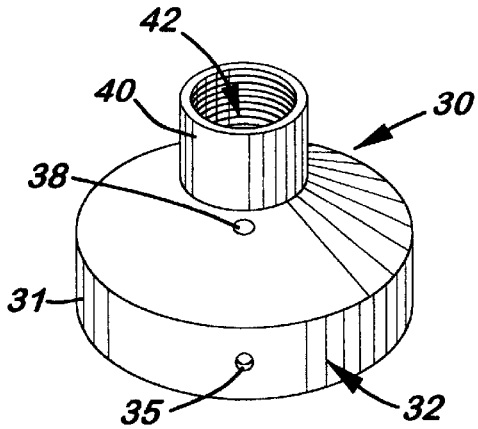
FIG. 4 is a perspective, inverted view of the landscape light adaptor.
Figure 5:
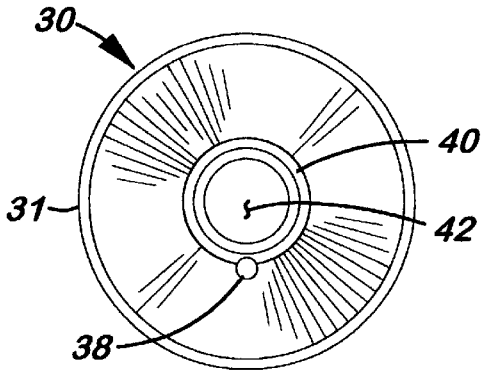
FIG. 5 is a top plan view of the invention.
Figure 6:
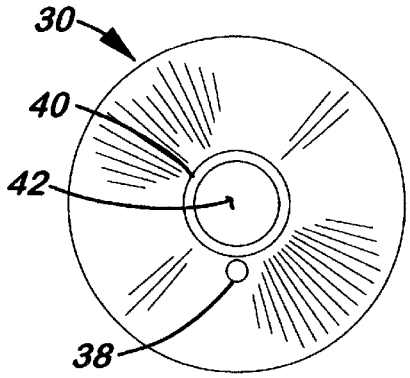
FIG. 6 is a bottom plan view of the invention.
Figure 7:
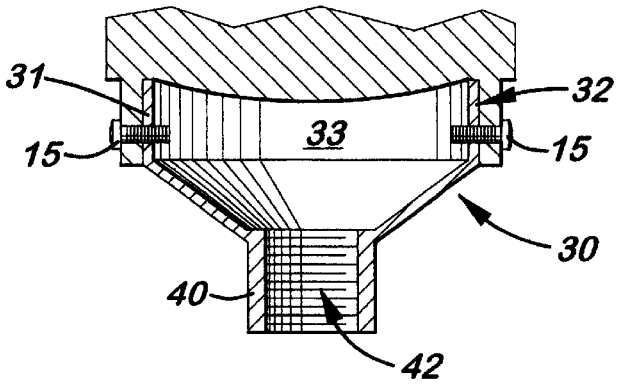
FIG. 7 is a right side elevation, cross-sectional view of the invention.

A complementary-shaped, narrow threaded conduit 15 may be connected to the threaded bore 42 in the neck member 40 as shown in FIG. 1. When a wide conduit 20 is desired, as shown in FIG. 2, the adaptor 30 is removed from the lower base 8. The end of the wide conduit 20 is inserted into the cavity 13 and attached thereto via the threaded connectors 12 extended through the tabs 10 and pressed against the wide conduit 20.

In the preferred embodiment, the upper section 32 on the adaptor 30 is approximately 3 inches in diameter with sidewalls approximately ¾ inch in height. The neck member 40 is approximately ½ inch in diameter and 1 inch in length. Also, the three bores 35 are equally spaced apart and radially aligned on the sidewalls 31. The adaptor 30 may also include an optional drain hole 38.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An adaptable landscape light for attaching a three-inch or ½-inch diameter pole, comprising:

a. a light housing including a cylindrical shaped lower base, said lower base including a downward extending, cylindrical-shaped cavity, said cavity being approximately three inches in diameter, said light housing member capable of slidingly connecting to a three inch diameter pole;

b. a removable adaptor with a cylindrical-shaped upper section and an integrally formed lower narrow neck member, said upper section capable of slidingly connecting to said cavity in said light housing, said lower narrow neck member being approximately ½ inch in diameter and capable of slidingly connecting to a ½-inch pole;

c. a means for selectively connecting said upper section of said adaptor to said cavity on said lower base on said light housing; and, d. a means for selectively connecting said neck member to a ½-inch diameter pole.

2. The landscape light, as recited in claim 1, whereby said means for attaching said upper section to said cavity is at least one first threaded bore formed on said lower base on said light housing and a second threaded bore formed on said upper section of said adaptor and a threaded connector, said threaded connector capable of connecting to said bores when said upper section is inserted into said light housing, and said first threaded bore and said second threaded bore are aligned and registered.

3. The landscape light, as recited in claim 1, wherein said means for selectively connecting said neck member to a narrow conduit is a threaded bore capable of connecting to threads formed on a ½ inch diameter conduit.

4. The landscape light, as recited in claim 2, wherein said means for selectively connecting said neck member to a narrow conduit is a threaded bore capable of connecting to threads formed on a ½ inch diameter conduit.

* * * * *